US008474249B2

(12) United States Patent
Zhou et al.

(10) Patent No.: US 8,474,249 B2
(45) Date of Patent: Jul. 2, 2013

(54) OPTIMIZATION OF SOOT DISTRIBUTION IN A DIESEL PARTICULATE FILTER

(75) Inventors: Shiguang Zhou, Ann Arbor, MI (US); Joel John Beltramo, West Bloomfield, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 1332 days.

(21) Appl. No.: 12/206,195

(22) Filed: Sep. 8, 2008

(65) Prior Publication Data

US 2010/0058744 A1 Mar. 11, 2010

(51) Int. Cl.
*F01N 3/00* (2006.01)
*F01N 3/02* (2006.01)

(52) U.S. Cl.
USPC ..... 60/297; 60/274; 60/311; 55/DIG. 30

(58) Field of Classification Search
USPC ..... 60/274, 295, 297, 299, 311; 55/DIG. 30, 55/524; 422/177, 178, 190
See application file for complete search history.

(56) References Cited

U.S. PATENT DOCUMENTS 6,568,178 B2 * 5/2003 Hirota et al. ..... 60/297
6,826,903 B2 12/2004 Yahata et al.
7,138,002 B2 11/2006 Hamanaka et al.
7,284,544 B2 10/2007 Hatano
7,673,448 B2 * 3/2010 Voss et al. ..... 60/297
2003/0097834 A1 5/2003 Gabe et al.
2005/0126140 A1 6/2005 Ito et al.
2006/0272625 A1 12/2006 Wang
2007/0092692 A1 4/2007 Masukawa et al.
2007/0092693 A1 4/2007 Okumura
2007/0231535 A1 10/2007 Mizutani

OTHER PUBLICATIONS

Zhou, S. et al., "Exhaust Gas Treatment System", U.S. Appl. No. 12/088,869, filed Aug. 8, 2008, 16 pages.

* cited by examiner

*Primary Examiner* — Binh Q Tran
*Assistant Examiner* — Diem Tran
(74) *Attorney, Agent, or Firm* — Julia Voutyras; Alleman Hall McCoy Russell & Tuttle LLP

(57) ABSTRACT

A diesel particulate filter (DPF) configured to separate a particulate from an engine exhaust is provided. The DPF comprises a downstream filtration stage including a plurality of downstream channels, an upstream filtration stage disposed upstream of and in fluidic communication with the downstream filtration stage, and including a plurality of upstream channels, and a shell at least partly enclosing the downstream filtration stage and the upstream filtration stage, the shell including an inlet configured to conduct the engine exhaust to the upstream filtration stage and an outlet configured to release the engine exhaust from the downstream filtration stage. The plurality of upstream channels may include a plurality of open upstream channels, the arrangement of which disperses the particulate more evenly over the plurality of downstream channels, as more flow is directed away from the major axis of the filter. In this way, during regeneration, it is possible to reduce one or both of longitudinal and radial thermal gradients, and thereby improve structural integrity of the filter.

18 Claims, 5 Drawing Sheets

OPTIMIZATION OF SOOT DISTRIBUTION IN A DIESEL PARTICULATE FILTER

TECHNICAL FIELD

The present application relates to the field of emissions control in motor vehicles, and more particularly, to control of particulate emissions from diesel-powered motor vehicles.

BACKGROUND AND SUMMARY

A diesel-engine exhaust system may include a diesel particulate filter (DPF) to limit particulate emissions. The DPF may include a cylindrical array of cells made of a porous material. Exhaust gas may be flowed through the DPF so that particulate matter entrained in the exhaust stream—soot, for example—is separated from the exhaust stream and collected within the cells.

As a DPF accumulates particulate matter, its capacity for continued exhaust filtration decreases. Therefore, a DPF at reduced capacity may be subject to a restoration phase, wherein high-temperature engine exhaust, hydrocarbon-rich engine exhaust, and/or nitrogen-dioxide rich engine exhaust—as examples—are provided to the DPF inlet. Soot trapped within the cells of the DPF may thereby be oxidized to volatile products, which flow from the DPF outlet in the filtered exhaust stream. The capacity of the DPF for subsequent filtration is thereby restored.

Oxidation of soot in the DPF is exothermic, however, and an uneven distribution of soot within the DPF may result in corresponding, uneven temperature gradients there within. Soot may deposit unevenly as a result of the fluid-flow pattern through the array of DPF cells; it may accumulate more heavily near the major axis and to the outlet side of the array, for example. When the temperature gradients in the DPF are not held within acceptable limits, inhomogeneous thermal expansion of DPF structures may lead to cracking and/or structural degradation, such as due to radial and longitudinal stresses related to the thermal temperature gradients across the structure.

Therefore, various approaches have been taken to lessen the temperature gradients experienced within a DPF during regeneration. For example, U.S. Patent Application Publication Number 2003/0097834 describes a DPF in which some cells near the major axis are closed off to limit exhaust flow and deposition of soot near the major axis. This approach attempts to lessen a radial component of the temperature gradient (i.e. the component from the major axis of the cell array to the exterior), but may not address a longitudinal component of the temperature gradient, i.e., from the outlet side of the array to the inlet side. This approach may also limit the capacity of the DPF by closing off cells throughout the entire length of the particular filtering material that may otherwise be used to trap exhaust-stream particulates.

The inventors herein have recognized these limitations and have devised a series of approaches to address them. Thus, in one embodiment, a DPF configured to separate a particulate from an engine exhaust is provided. The DPF comprises a downstream filtration stage including a plurality of downstream channels, an upstream filtration stage disposed upstream of and in fluidic communication with the downstream filtration stage, and including a plurality of upstream channels, and a shell at least partly enclosing the downstream filtration stage and the upstream filtration stage, the shell including an inlet configured to conduct the engine exhaust to the upstream filtration stage and an outlet configured to release the engine exhaust from the downstream filtration stage. In one embodiment, the plurality of upstream channels includes a plurality of open upstream channels, the arrangement of which disperses the particulate more evenly over the plurality of downstream channels, as more flow is directed away from the major axis of the filter. In this way, during regeneration, it is possible to reduce one or both of longitudinal and radial thermal gradients, and thereby improve structural integrity of the filter.

Other embodiments provide an exhaust aftertreatment system comprising a DPF and a diesel-oxidation catalyst module, and a method to restore a capacity of a DPF.

It should be understood that the summary above is provided to introduce in simplified form a selection of concepts that are further described in the Detailed Description. It is not meant to identify key or essential features of the claimed subject matter, the scope of which is defined uniquely by the claims that follow the Detailed Description. Further, the claimed subject matter is not limited to implementations that solve any disadvantages noted above or in any part of this disclosure.

DETAILED DESCRIPTION

Figure 1:
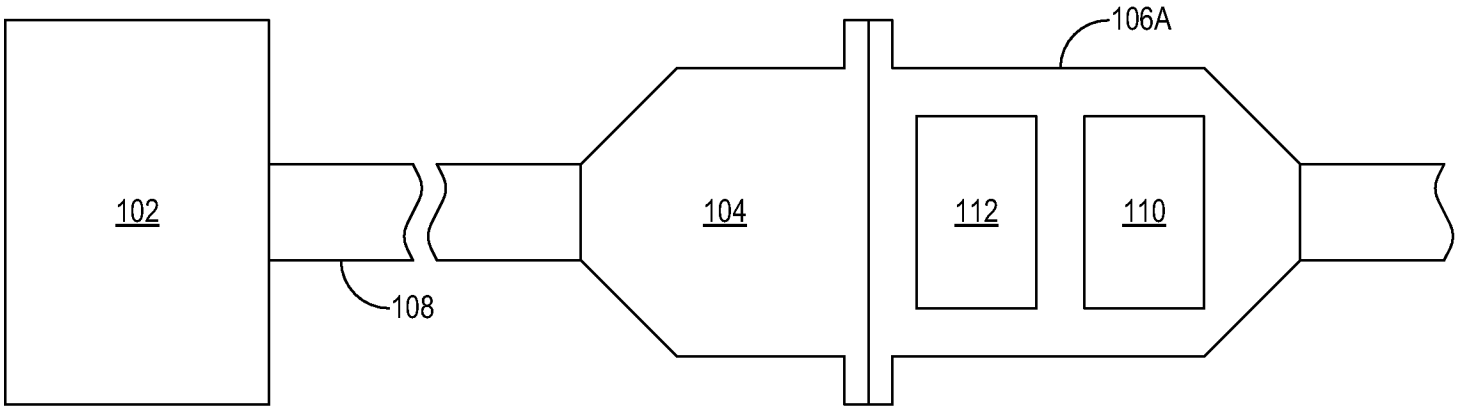
FIG. 1 shows part of an example motor-vehicle exhaust system in schematic detail, in accordance with the present disclosure.

FIG. 1 shows part of an example motor-vehicle exhaust system in schematic detail. In particular, FIG. 1 shows exhaust manifold 102 of a motor-vehicle engine, diesel oxidation-catalyst module 104, and DPF 106A, configured to separate a particulate from an engine exhaust. In the illustrated embodiment, the diesel oxidation-catalyst module and the DPF are coupled together, with the DPF disposed downstream of and in fluidic communication with the diesel oxidation catalyst module. The illustrated embodiment further includes exhaust conduit 108, configured to conduct exhaust gas from the exhaust manifold to the diesel oxidation catalyst module. With this configuration, exhaust gas from the engine may pass from the exhaust manifold directly or indirectly to the diesel oxidation catalyst module, then on to the DPF and other, downstream elements of the exhaust system.

It will be understood that exhaust conduit 108 may conduct the engine exhaust through one or more other devices en route to diesel oxidation catalyst module 104. Thus, some embodiments may include one or more of a temperature sensor, a lean NOX trap, and a three-way catalyst module—as examples—disposed downstream of exhaust manifold 102 and upstream of diesel oxidation catalyst module 104, and in fluidic communication therewith via exhaust conduit 108.

In the illustrated embodiment, DPF 106A includes two filtration stages: downstream filtration stage 110 and upstream filtration stage 112. As shown in FIG. 1 and described in greater detail below, the upstream filtration stage is disposed upstream of and in fluidic communication with the downstream filtration stage.

Figure 2:
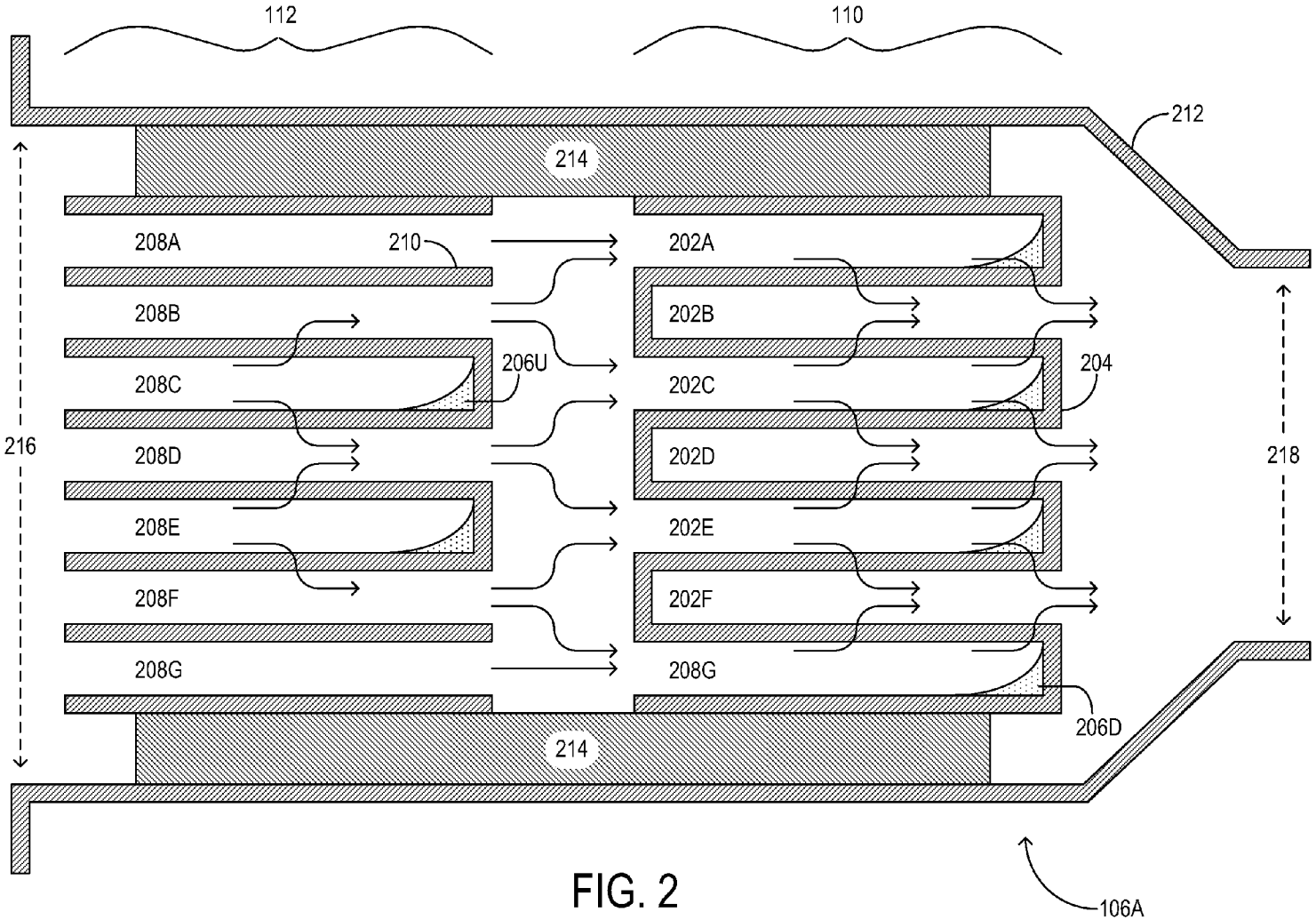
FIG. 2 shows an example DPF, in accordance with the present disclosure.

FIG. 2 shows example DPF 106A, downstream filtration stage 110, and upstream filtration stage 112 in schematic cross section. In the illustrated embodiment, downstream filtration stage 110 includes a plurality of downstream flow channels, viz., downstream flow channels 202A through 202G. In this example, the plurality of downstream flow channels are formed in downstream channel wall 204, which is made of a porous, heat-resistant material, e.g. cordierite. The plurality of downstream flow channels shown in the figure includes a plurality of inlet downstream channels closed at an outlet end (viz., 202A, 202C, 202E, and 202G) and a plurality of outlet downstream channels closed at an inlet end (viz., 202B, 202D, 202F). The plurality of downstream flow channels are thus configured to separate particulate 206D, e.g. soot, from an exhaust stream flowing therethrough.

In the illustrated embodiment, upstream filtration stage 112 includes a plurality of upstream flow channels, viz., upstream flow channels 208A through 208G. In this example, the plurality of upstream flow channels are formed in upstream channel wall 210, which is also made of a porous, heat-resistant material, substantially the same or at least partly different than the material from which downstream channel wall 204 is formed.

In some embodiments, one or both of downstream filtration stage 110 and upstream filtration stage 112 may include a catalyst wash coat, e.g., a coating of an oxidation catalyst. In one non-limiting example, a plurality of equivalent or inequivalent catalyst wash coats may be applied to downstream channel wall 204 and/or upstream channel wall 210. A catalyst wash coat may be applied by spraying, dipping, soaking, or in any other suitable manner. In some embodiments, the catalyst wash coat may include a platinum-group metal. With respect to the coverage of the catalyst wash coat, various embodiments are contemplated. The appropriate wash-coat coverage may depend, for example, on the details of a restorative operation (vide infra) used to restore the capacity of the DPF after it has accumulated particulate matter. In some embodiments, both the downstream filtration stage and the upstream filtration stage may include a catalyst wash coat of the same coverage. In other embodiments, the coverage of the catalyst wash coat applied to the upstream filtration stage may be greater than that applied to the downstream filtration stage. In one embodiment, the coverage of the catalyst wash coat applied to the downstream filtration stage may be approximately 3 grams per cubic foot or less of a platinum-group metal catalyst. In still other embodiments, the downstream filtration stage may lack a catalyst wash coat.

FIG. 2 shows upstream filtration stage 112 and downstream filtration stage 110 disposed in shell 212, and separated from the shell by mat 214. In the illustrated embodiment, the shell at least partly encloses the downstream filtration stage and the upstream filtration stage. It includes inlet 216 configured to conduct engine exhaust to the upstream filtration stage, and outlet 218 configured to release a filtered engine exhaust from the downstream filtration stage.

The inventors herein have identified an aspect ratio of a DPF filtration stage, i.e. the ratio of the length of the DPF filtration stage to its height, as one factor that may influence a tendency of the DPF filtration stage to crack during a restoration phase. For example, the tendency to crack may increase when the aspect ratio is greater than 120 percent. Therefore, in some embodiments, the length of downstream filtration stage 110 parallel to the direction of exhaust flow may be less than its height; the length may be 80-120 percent of the height, for example. Further, in embodiments where the downstream filtration stage is substantially cylindrical, the length of the downstream filtration stage may be 80-120 percent of its diameter.

However, from the point of view of motor-vehicle design, it may be advantageous for the DPF shell to have an aspect ratio significantly greater than 120 percent. Therefore, in some embodiments, the length of shell 212 parallel to the direction of exhaust flow may be greater than the height of the shell; the length may be 100-150 percent of the height, for example. Thus, by providing multiple filtration stages in the same shell, the aspect ratios of the shell and of the filtration stages may be adjusted independently of each other, resulting in the combined advantages of each optimization.

The inventors herein have further identified a radial distribution of soot collected in a DPF filtration stage as another factor that may influence the tendency of the DPF to crack during a restoration phase. By inference, thermal stresses within the DPF filtration stage during the restoration phase may be reduced by collecting soot more uniformly within the DPF filtration stage and avoiding localized 'hot spots,' where a great majority of the soot is collected.

It may be observed that a pattern of particulate collection in a filter where each channel has a closed end tends to concentrate the particulate toward the center of the filter, with relatively less particulate collected at the periphery. For a more uniform pattern of particulate collection, the fluid flow may be biased toward the periphery and away from the center. In the present disclosure, such bias is provided by disposing an upstream filtration stage in front of the downstream filtration stage, wherein a plurality of more facile flow paths are disposed at the periphery.

Thus, continuing in FIG. 2, the plurality of upstream flow channels 208A through 208G includes a plurality of open upstream channels, viz., 208A, 208B, 208D, 208F, and 208G. As shown in the figure, the open upstream channels are closed neither at the upstream end nor at the downstream end, while the balance of the upstream flow channels are closed at the downstream end.

Figure 3:
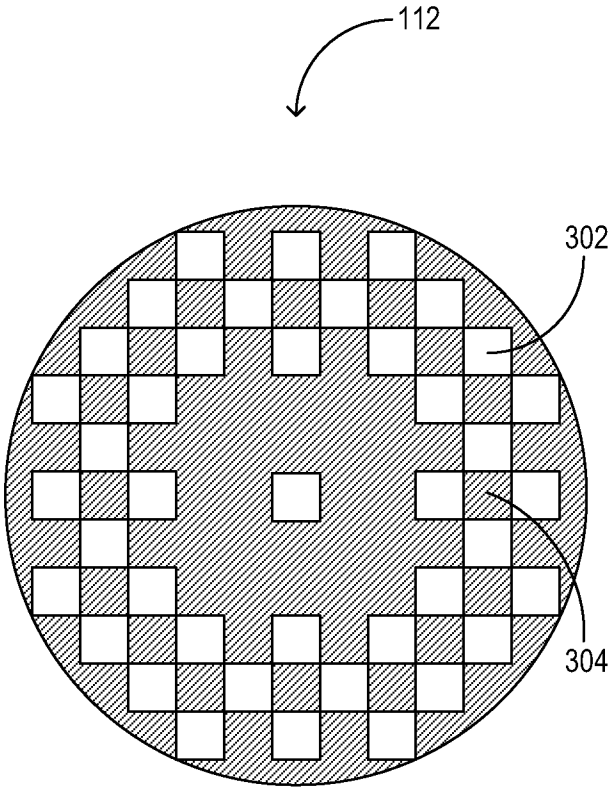
FIG. 3 shows an example upstream filtration stage of an example DPF, in accordance with the present disclosure.

FIG. 3 shows upstream filtration stage 112 from the point of view of the downstream filtration stage. In the drawing, open upstream channels are represented as clear squares, e.g., clear square 302, while the remaining upstream flow channels are represented as hashed squares, e.g., hashed square 304. By disposing a greater density of open upstream channels at the periphery of the upstream filtration stage, and a lesser density at the center, soot may be collected more uniformly in the downstream filtration stage. During the restoration phase, therefore, the radial component of a temperature gradient through the downstream filtration stage may be smaller, and the downstream filtration stage may be less susceptible to cracking; yet, it is still possible to collect at least some soot in the upstream filtration stage, at least in this example.

Thus, in some embodiments, the open upstream channels in upstream filtration stage 112 may be arranged inhomogeneously among the upstream channels, an inhomogeneous arrangement of open upstream channels and upstream channels configured to disperse the particulate evenly over the plurality of downstream channels. In particular, the inhomogeneous arrangement may include a greater density of open upstream channels at a peripheral region of the upstream filtration stage than at a center region of the upstream filtration stage. In one embodiment, the inhomogeneous arrangement may include a density of open upstream channels increasing from a center of the upstream filtration stage to a periphery of the upstream filtration stage. In this way, the upstream filtration stage may be configured to collect a greater density of the particulate in a center region of the upstream filtration stage than in a peripheral region of the upstream filtration stage.

It will be understood that FIGS. 2 and 3 are entirely schematic, and many aspects of the embodiments are rendered in simplified form to enable a clear description. For example, some embodiments fully consistent with this disclosure may include a far greater number of flow channels in each of downstream filtration stage 110 and upstream filtration stage 112. Further, the cross-sectional shape of the flow channels, while rendered square in the drawings, may in other embodiments include any geometric figure or set of figures admitting of a close-packed array—triangles, hexagons, parallelograms, as examples.

Figure 4:
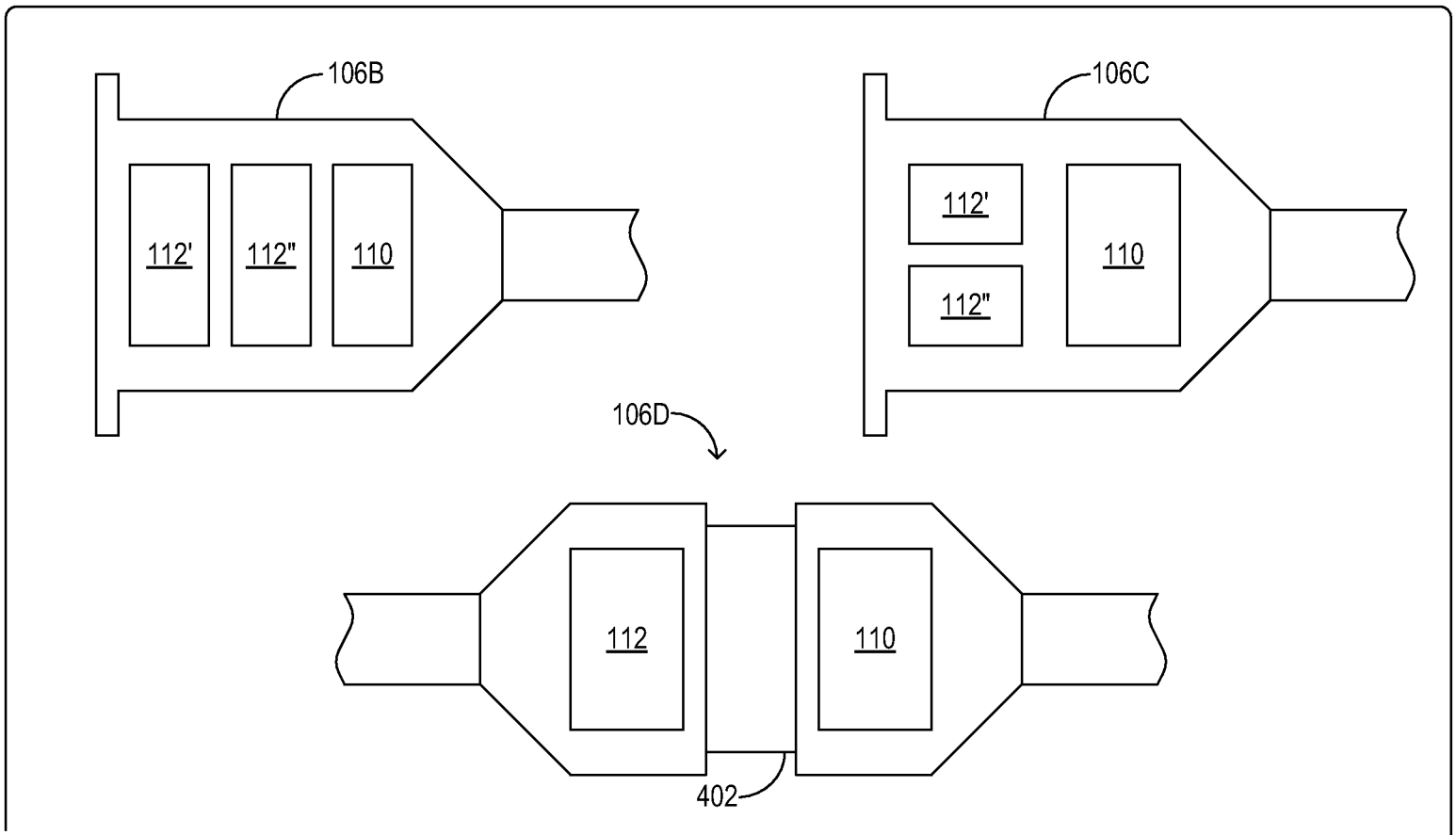
FIG. 4 shows additional example DPF's, in accordance with the present disclosure.

FIG. 4 shows in schematic detail a number of other DPF embodiments. In some embodiments, the upstream filtration stage may be one of a plurality of upstream filtration stages, each disposed upstream of and in fluidic communication with the downstream filtration stage. Thus, DPF 106B includes a single downstream filtration stage 110 disposed downstream of and in fluidic communication with two upstream filtration stages: first upstream filtration stage 112' and second upstream filtration stage 112", which are fluidically coupled to each other in series. In this embodiment, one or both of the first and second upstream filtration stages may be substantially the same or at least partly different than upstream filtration stage 112 described hereinabove.

DPF 106C also includes a single downstream filtration stage 110 and two upstream filtration stages, 112' and 112", disposed upstream of and in fluidic communication with the downstream filtration stage. However, this embodiment differs from DPF 106B in that the two upstream filtration stages are disposed in parallel, not in series.

DPF 106D includes a single downstream filtration stage 110 and a single upstream filtration stage 112 disposed upstream of and in fluidic communication with the downstream filtration stage. In this embodiment, fluidic communication between the two filtration stages is provided via a broad conduit disposed therebetween.

Figure 5:
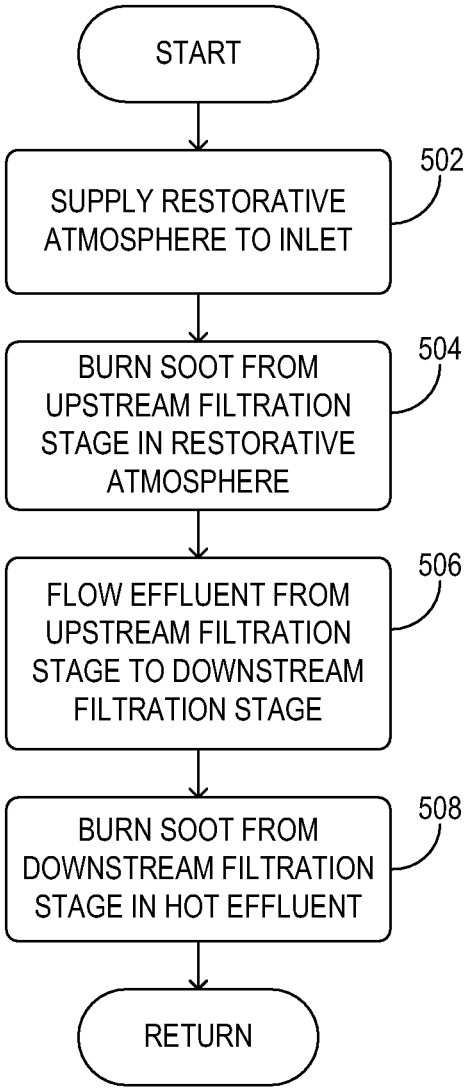
FIG. 5, by way of a flow chart, illustrates an example method to restore a capacity of a DPF, in accordance with the present disclosure.

FIG. 5, by way of a flow chart, illustrates an example method to restore a capacity of a DPF, wherein the DPF is configured in accordance with one or more of the embodiments described hereinabove. The method may be executed automatically by an electronic control system of the motor vehicle in which the DPF is installed. In some embodiments, the control system may execute the method at regular time and/or mileage intervals, e.g., every 100 hours of operating time, every 1000 miles, etc. Further, or alternatively, the control system may execute the method when a pressure sensor response indicates that the capacity of the DPF is reduced: when an exhaust back pressure increases above a threshold, for example. Further still, the control system may estimate soot accumulation based on various operating conditions, and perform regeneration based on the estimated soot level reaching a threshold.

The illustrated method of FIG. 5 begins at 502, where a restorative atmosphere is supplied to an inlet of the DPF. In one example, the restorative atmosphere may comprise a high temperature and/or fuel-rich engine exhaust. The fuel-rich engine exhaust may be provided via a modified intake and/or exhaust valve timing, a modified intake air-to-fuel ratio, or, in engine systems appropriately configured, by injecting fuel into the exhaust stream or late in the cylinder late in the exhaust stroke. In another example, the restorative atmosphere may comprise a nitrogen-dioxide rich engine exhaust. The nitrogen-dioxide rich or oxygen rich engine exhaust may be provided via a modified valve timing and/or intake air-to-fuel ratio, as above. In still other examples, the restorative atmosphere may comprise a fuel-borne catalyst which is mixed with the fuel during the restoration phase and is carried through the exhaust system to the DPF.

The method continues to 504, where soot collected in an upstream filtration stage of the DPF is burned in the restorative atmosphere. Thus, in each of the above examples, introduction of the restorative atmosphere promotes an oxidation of soot in at least the upstream filtration stage of the DPF. The restorative atmosphere may or may not promote oxidation of soot in the downstream filtration stage.

Whether or not the restorative atmosphere promotes oxidation of soot in the downstream filtration stage, it is inferred that oxidation of soot in the upstream filtration stage, being highly exothermic, can generate an effluent energetic enough to oxidize and remove the soot from the downstream filtration stage. Therefore, the method continues to 506, where effluent from the upstream filtration stage is flowed to the downstream filtration stage, and to 508, where soot collected in the downstream filtration stage is burned in the hot effluent created at 504.

Thus, in some embodiments, the upstream filtration stage may be restored actively, i.e., in the restorative atmosphere, and the downstream filtration stage may be restored passively, i.e., in the hot effluent emerging from the upstream filtration stage during the restoration phase.

In connection to the example restoration method, the inventors herein have identified a significant advantage in dividing the DPF into upstream and downstream filtration stages and applying a restorative atmosphere largely to the upstream filtration stage. Namely, the restoration phase may be made more controllable, such that undesirably rapid heating of the DPF, excessive temperature gradients, and cracking, may be avoided.

Finally, in some embodiments described hereinabove, inequivalent catalyst wash coat coverages are applied to upstream and downstream filtration stages. These embodiments anticipate a multi-stage restoration strategy as described in the example method. Specifically, it is contemplated that a lower catalyst wash-coat coverage (or no wash coat at all) may be appropriate for the passively restored downstream filtration stage, and a relatively greater catalyst wash-coat coverage may be appropriate for the actively restored upstream filtration stage.

It will be understood that the example control and estimation routines disclosed herein may be used with various system configurations. These routines may represent one or more different processing strategies such as event-driven, interrupt-driven, multi-tasking, multi-threading, and the like. As such, the disclosed process steps (operations, functions, and/or acts) may represent code to be programmed into computer readable storage medium in a control system. It should be understood that some of the process steps described and/or illustrated herein may in some embodiments be omitted without departing from the scope of this disclosure. Likewise, the indicated sequence of the process steps may not always be required to achieve the intended results, but is provided for ease of illustration and description. One or more of the illustrated actions, functions, or operations may be performed repeatedly, depending on the particular strategy being used.

Finally, it should be understood that the systems and methods described herein are exemplary in nature, and that these specific embodiments or examples are not to be considered in a limiting sense, because numerous variations are contemplated. Accordingly, the present disclosure includes all novel and non-obvious combinations and sub-combinations of the various systems and methods disclosed herein, as well as any and all equivalents thereof.

The invention claimed is:

1. A diesel particulate filter configured to separate a particulate from an engine exhaust, the diesel particulate filter comprising:

a downstream filtration stage including a plurality of downstream channels;

an upstream filtration stage disposed upstream of and in fluidic communication with the downstream filtration stage, and including a plurality of upstream channels; and a shell at least partly enclosing the downstream filtration stage and the upstream filtration stage, the shell including an inlet configured to conduct the engine exhaust to the upstream filtration stage and an outlet configured to release the engine exhaust from the downstream filtration stage, one or more of the downstream and upstream channels including an oxidation catalyst wash coat, wherein the plurality of upstream channels includes a plurality of open upstream channels, and where the open upstream channels include the oxidation catalyst wash coat, and wherein the open upstream channels are arranged inhomogeneously among the upstream channels, an inhomogeneous arrangement of open upstream channels and upstream channels configured to disperse the particulate evenly over the plurality of downstream channels.

2. The diesel particulate filter of claim 1, wherein the inhomogeneous arrangement includes a density of open upstream channels greater at a peripheral region of the upstream filtration stage than at a center region of the upstream filtration stage, and where the downstream channels include the oxidation catalyst wash coat, where a greater coverage of the oxidation catalyst wash coat is applied to the upstream filtration stage than that applied to the downstream filtration stage.

3. The diesel particulate filter of claim 1, wherein the inhomogeneous arrangement includes a density of open upstream channels increasing from a center of the upstream filtration stage to a periphery of the upstream filtration stage.

4. The diesel particulate filter of claim 1, wherein the upstream filtration stage is configured to collect a greater density of the particulate in a center region of the upstream filtration stage than in a peripheral region of the upstream filtration stage.

5. The diesel particulate filter of claim 1, wherein the plurality of downstream channels includes a plurality of inlet downstream channels closed at an outlet end and a plurality of outlet downstream channels closed at an inlet end.

6. The diesel particulate filter of claim 1, the shell having a length parallel to a direction of exhaust flow, and a height perpendicular to the length, wherein the length is greater than 120 percent of the height.

7. The diesel particulate filter of claim 1, wherein at least one of the upstream filtration stage and the downstream filtration stage comprise a cordierite-based material.

8. The diesel particulate filter of claim 1, wherein the upstream filtration stage is one of a plurality of upstream filtration stages, each disposed upstream of and in fluidic communication with the downstream filtration stage.

9. The diesel particulate filter of claim 8, wherein the plurality of upstream filtration stages are fluidically coupled to each other in series.

10. The diesel particulate filter of claim 1, the downstream filtration stage having a length parallel to a direction of exhaust flow, and a height perpendicular to the length, wherein the length is 80 to 120 percent of the height.

11. The diesel particulate filter of claim 10, wherein the downstream filtration stage is cylindrical, and the height is a diameter of the downstream filtration stage.

12. The diesel particulate filter of claim 1, wherein the oxidation catalyst wash coat applied to the downstream filtration stage is absent or of lesser coverage than the oxidation catalyst wash coat applied to the upstream filtration stage.

13. The diesel particulate filter of claim 12, wherein the oxidation catalyst wash coat applied to the downstream filtration stage comprises 3 grams per cubic foot or less of a platinum-group metal catalyst.

14. An exhaust-aftertreatment assembly comprising:

a diesel particulate filter comprising:

a downstream filtration stage including a plurality of downstream channels;

an upstream filtration stage disposed upstream of and in fluidic communication with the downstream filtration stage, and including a plurality of upstream channels, the plurality of upstream channels including a plurality of open upstream channels, the upstream filtration stage including a wash coat having an oxidation catalyst, the wash coat applied at least to a channel wall of one or more of the open upstream channels, wherein the open upstream channels are arranged inhomogeneously among the upstream channels, an inhomogeneous arrangement of open upstream channels and upstream channels configured to disperse particulate evenly over the plurality of downstream channels, with a density of open upstream channels greater at a peripheral region of the upstream filtration stage than at a center region of the upstream filtration stage.

15. The exhaust-aftertreatment assembly of claim 14, further comprising a shell at least partly enclosing the downstream filtration stage and the upstream filtration stage, the shell including an inlet configured to conduct the engine exhaust to the upstream filtration stage and an outlet configured to release the engine exhaust from the downstream filtration stage, the downstream filtration stage lacking an oxidation catalyst wash coat.

16. A method to restore a capacity of a diesel particulate filter, the method comprising:

supplying a restorative atmosphere to an inlet of the diesel particulate filter, the diesel particulate filter configured to separate a particulate from an engine exhaust and comprising:

a downstream filtration stage including a plurality of downstream channels;

an upstream filtration stage disposed upstream of and in fluidic communication with the downstream filtration stage, and including a plurality of upstream channels, the plurality of upstream channels including a plurality of open upstream channels, an inhomogeneous arrangement of upstream channels and open upstream channels configured to disperse the particulate evenly over the plurality of downstream channels, where the upstream channels include an oxidation catalyst wash coat; and a shell at least partly enclosing the downstream filtration stage and the upstream filtration stage, the shell including an inlet configured to conduct the engine exhaust to the upstream filtration stage and an outlet configured to release the engine exhaust from the downstream filtration stage;

burning soot from the upstream filtration stage in the restorative atmosphere, the restorative atmosphere promoting an oxidation of soot in at least the upstream filtration stage;

flowing a hot effluent from the upstream filtration stage into the downstream filtration stage; and burning soot from the downstream filtration stage in the hot effluent from the upstream filtration stage.

17. The method of claim 16, wherein the restorative atmosphere comprises one or more of a fuel-rich engine exhaust, a nitrogen-dioxide rich engine exhaust, and a fuel-borne catalyst.

18. An exhaust-aftertreatment assembly comprising:

a diesel particulate filter housing including:

a downstream filtration stage with all downstream channels having alternating closed and open inlets and outlets, respectively;

an upstream filtration stage with upstream channels having:

central channels with closed outlets and open inlets, radially peripheral channels having open inlets and outlets of a higher density than at a center region and arranged inhomogeneously among the upstream channels, and an oxidation catalyst wash coat.

* * * * *